US005496963A

United States Patent [19]

Ito

[11] Patent Number: 5,496,963

[45] Date of Patent: Mar. 5, 1996

[54] ELECTRONIC MUSICAL INSTRUMENT THAT ASSIGNS A TONE CONTROL PARAMETER TO A SELECTED KEY RANGE ON THE BASIS OF A LAST OPERATING KEY

[75] Inventor: Shinichi Ito, Hamamatsu, Japan

[73] Assignee: Yamaha Corporation, Japan

[21] Appl. No.: 792,232

[22] Filed: Nov. 14, 1991

[30] Foreign Application Priority Data

Nov. 16, 1990 [JP] Japan ..... 2-310243

[51] Int. Cl.[6] ..... G10H 1/18

[52] U.S. Cl. ..... 84/653; 84/478

[58] Field of Search ..... 84/615–620, 653–658, 84/478

[56] References Cited

U.S. PATENT DOCUMENTS 4,365,532 12/1982 Nakada et al. ..... 84/615

5,105,709 4/1992 Suzuki ..... 84/615

*Primary Examiner*—Stanley J. Witkowski

*Attorney, Agent, or Firm*—Graham & James

[57] ABSTRACT

A musical instrument having a keyboard on which a plurality of keys are provided. The keys of keyboard are divided into a plurality of key ranges each including a plurality of keys. The key ranges are set based on a division point which is designated by a division point designation member, for example, a split switch. A tone control parameter, such as a timbre code, is input by operating a parameter input member, such as a timbre designation switch. A parameter assign member selects one of the key ranges which is determined based on a key range including a key which has been depressed latest, and assigns the input tone control parameter for the musical tone generation of the musical tones corresponding to the selected key range.

4 Claims, 5 Drawing Sheets

ELECTRONIC MUSICAL INSTRUMENT THAT ASSIGNS A TONE CONTROL PARAMETER TO A SELECTED KEY RANGE ON THE BASIS OF A LAST OPERATING KEY

BACKGROUND OF THE INVENTION

1. Field of the Invention

The present invention relates to electronic musical instruments, in particular to keyboard type electronic musical instruments which have a keyboard as a performance instruction input device.

2. Prior Art

Conventional keyboard-type electronic musical instruments are known which have a tone control parameter setting function for divided key ranges. In this type of instrument, the keys of the keyboard are divided into several key ranges each including a plurality of keys, and tone control parameters can be set for each key range. There are first and second types of the keyboard-type electronic musical instrument having tone control parameter setting function for divided key ranges as follows:

(1) In the first type instrument, parameter designation operational members for designating tone control parameters are provided for every key range in a redundant manner. A tone control parameter is entered through the operation for one of the parameter designation operational members, which corresponds to the desired key range, the entered parameter is set to the key range corresponding to the operated member.

(2) In the second type instrument, parameter designation operational members for designating tone control parameters are commonly provided for all key ranges, and a key range designation operational member is provided. Performance parameters entered through the operation of the parameter designation operational members are set to the key range which is designated by the key range designation operational member.

However, the first type electronic musical instruments have a problem in that they need an extremely large area for providing parameter designation operational members for every key range. The second type electronic musical instruments have a problem in that it is difficult to set the tone control parameter rapidly because the performer should operate the key range designation operational member to designate the desired key range before operating the parameter designation operational members: specifically, it is extremely difficult to designate the tone control parameters during performance.

SUMMARY OF THE INVENTION

In consideration of the above-described disadvantages of conventional electronic musical instruments, an object of the present invention is to provide an electronic musical instrument which allows that a performer can select one of the key ranges, each created by dividing the keys on the keyboard, and quickly set a desired tone control parameter for the selected key range by using the parameter designation operational members which are commonly provided for every key ranges.

The present invention relates to an electronic musical instrument having a keyboard, on which a plurality of keys are provided, which generates musical tones based on the operation applied to the keys. The electronic musical instrument is comprised of:

a division point designator for designating at least one division point dividing the keys of the keyboard into a plurality of key ranges; a parameter inputter for inputting a desired tone control parameter; and a parameter assigner for selecting one of the key ranges which is determined based on a key range including a key which has been operated, and for assigning the input tone control parameter for the musical tone generation of the musical tones corresponding to the selected key range.

Other aspects and advantages of the present invention will be further understood from the preferred embodiments of the present invention described in a following section with reference to the drawings.

DETAILED DESCRIPTION OF THE PREFERRED EMBODIMENTS

In the following, the preferred embodiments of the the present invention will be described in detail with reference to the drawings.

Figure 1:
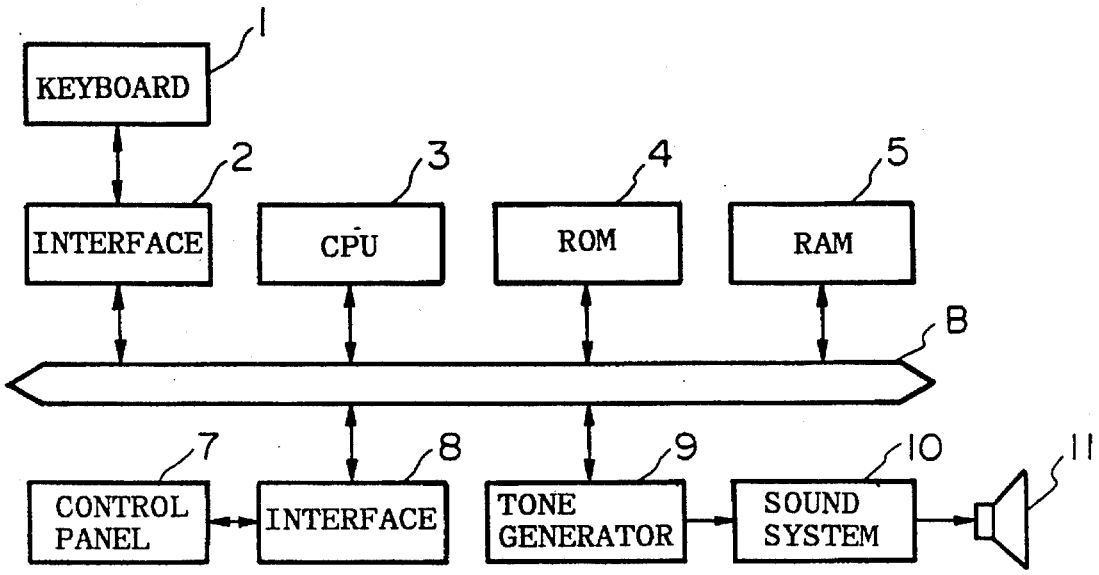
FIG. 1 is a block diagram showing an electronic configuration of an electronic musical instrument according to a preferred embodiment of the present invention.

FIG. 1 is a block diagram showing the electrical configuration of an electronic musical instrument in accordance with a preferred embodiment of the present invention. In FIG. 1, 1 designates a keyboard having a plurality of keys; 2 designates an interface for detecting and outputting operational events, such as a key-on event, which occur in keyboard 1; 3 designates CPU (Central Processing Unit) for controlling the respective element of this electronic musical instrument; 4 designates a ROM (Read Only Memory) which stores a plurality of control programs to be executed by CPU 3; 5 designates a RAM (Random Access Memory) used by CPU i for temporarily storing data; 7 designates a control panel on which a plurality of operational members for designating tone control parameters are provided; 8 designates an interface for detecting and outputting the operational events of the operational members provided on control panel 7; 9 designates a PCM (Pulse Code Modulation) type tone generator for generating musical tones; 10 and 11 designate a sound system and a loudspeaker respectively for outputting musical tones generated by tone generator 9; and B designates data bus which connects the above-described elements 2, 3, 4, 5, 8 and 9.

Figure 2:
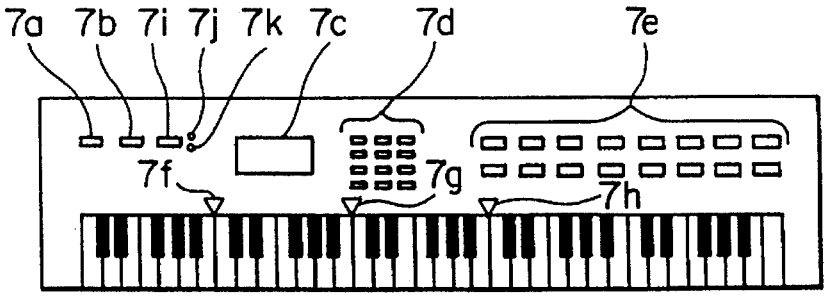
FIG. 2 is a plane view diagram showing an external appearance of the electronic musical instrument shown in FIG. 1.

FIG. 2 is a plane view diagram showing an external appearance of the electronic musical instrument. The description will be given with respect to operational members and displays provided on control panel 7 with reference to FIG. 2. In FIG. 2, *7a* designates a power switch. *7b* designates a split key for directing the movement of a division point which divide all keys of keyboard 1 into two key ranges. *7c* designates a display for displaying informations, such as a timbre. *7d* designates a group of key switches including ten-key and enter-key for entering numerical data, such as timbre code. *7e* designates a group of switches consisting of sixteen timbre designation switches used for the setting of the timbre. 7f through 7h designate LEDs (Light Emitting Diodes) for indicating the division point which divides the keys of keyboard 1 into an upper key range and a lower key range. LEDs 7f through 7h are provided at the positions which can be respectively defined as division points. The division point moves in a cyclic manner such as from the position of LED 7f to the position of LED 7g, from the position of LED 7g to the position of LED 7h, and from the position of LED 7h to the position of LED 7f: every time split key 7b is depressed, the LED which is positioned at the current division point is lighted up. In this electronic musical instrument, there are provided two types of timbre setting functions in which a timbre code is set for a desired key range. In the first timbre setting function, the timbre code is set for the key range which includes keys of keyboard 1 which has been depressed by a performer. In the second timbre setting function, the timbre code is set for the other key ranges which do not include the depressed keys. The first and second timbre setting functions are alternately selected every time a function selection key 7i is depressed.

Figure 5:
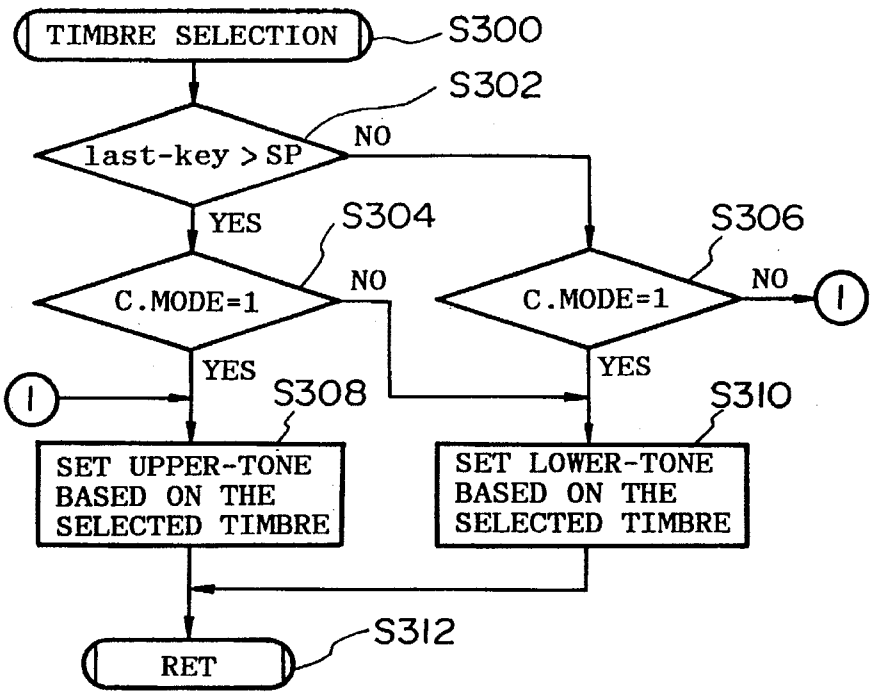
FIGS. 3 through 7 are flow charts showing the operation of the electronic musical instrument shown in FIG. 1.
Figure 3:
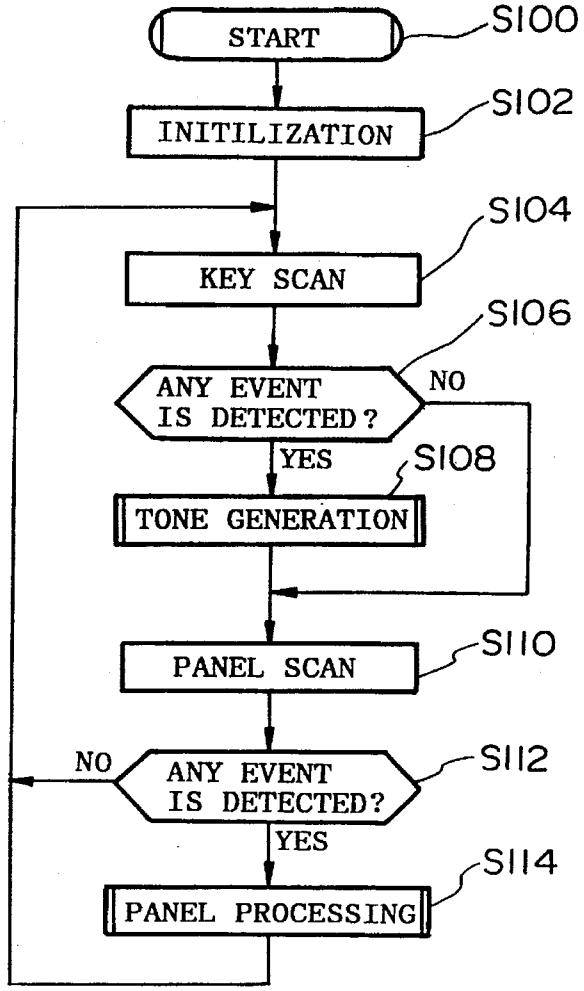
Figure 4:
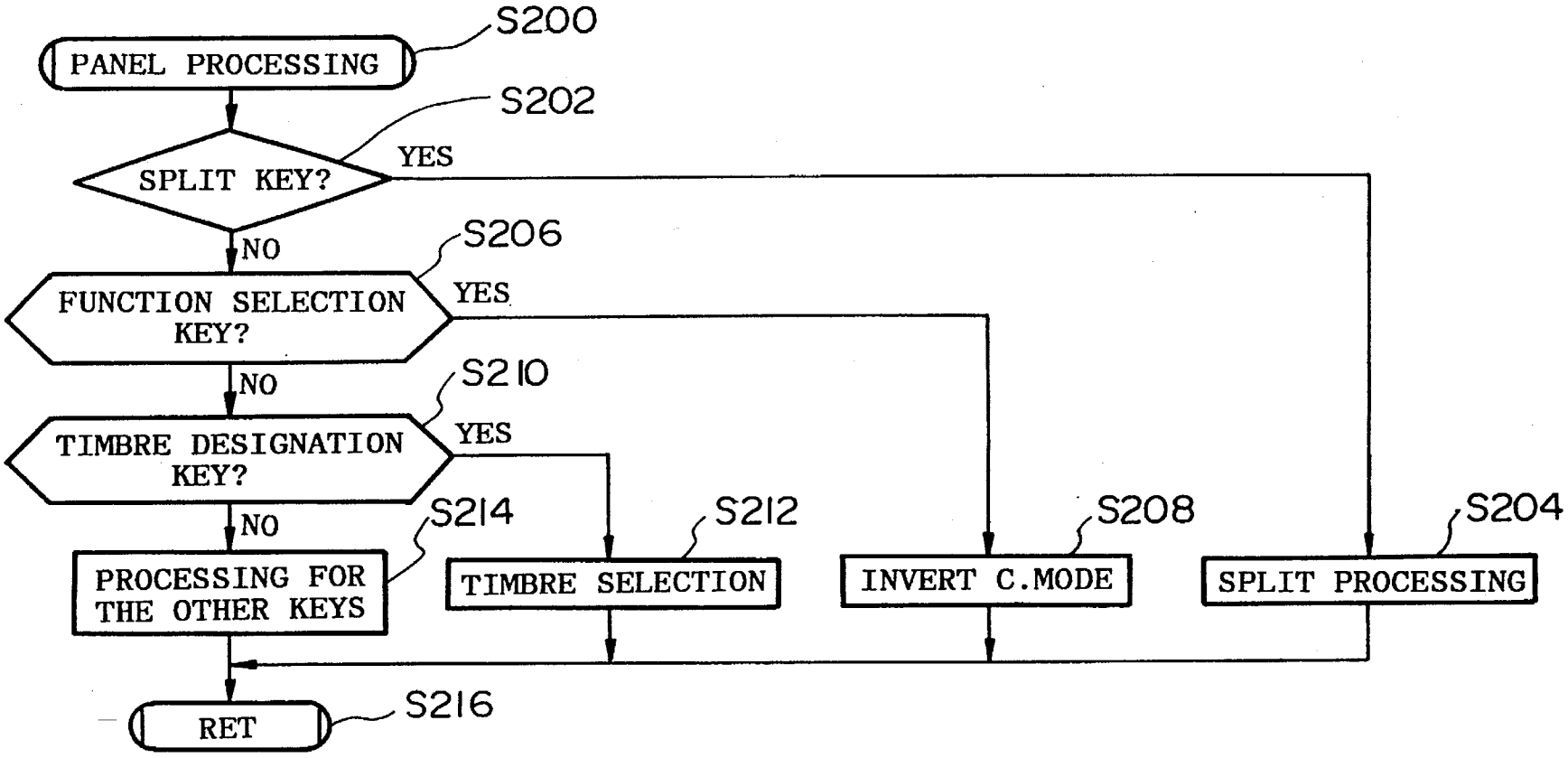
Figure 6:
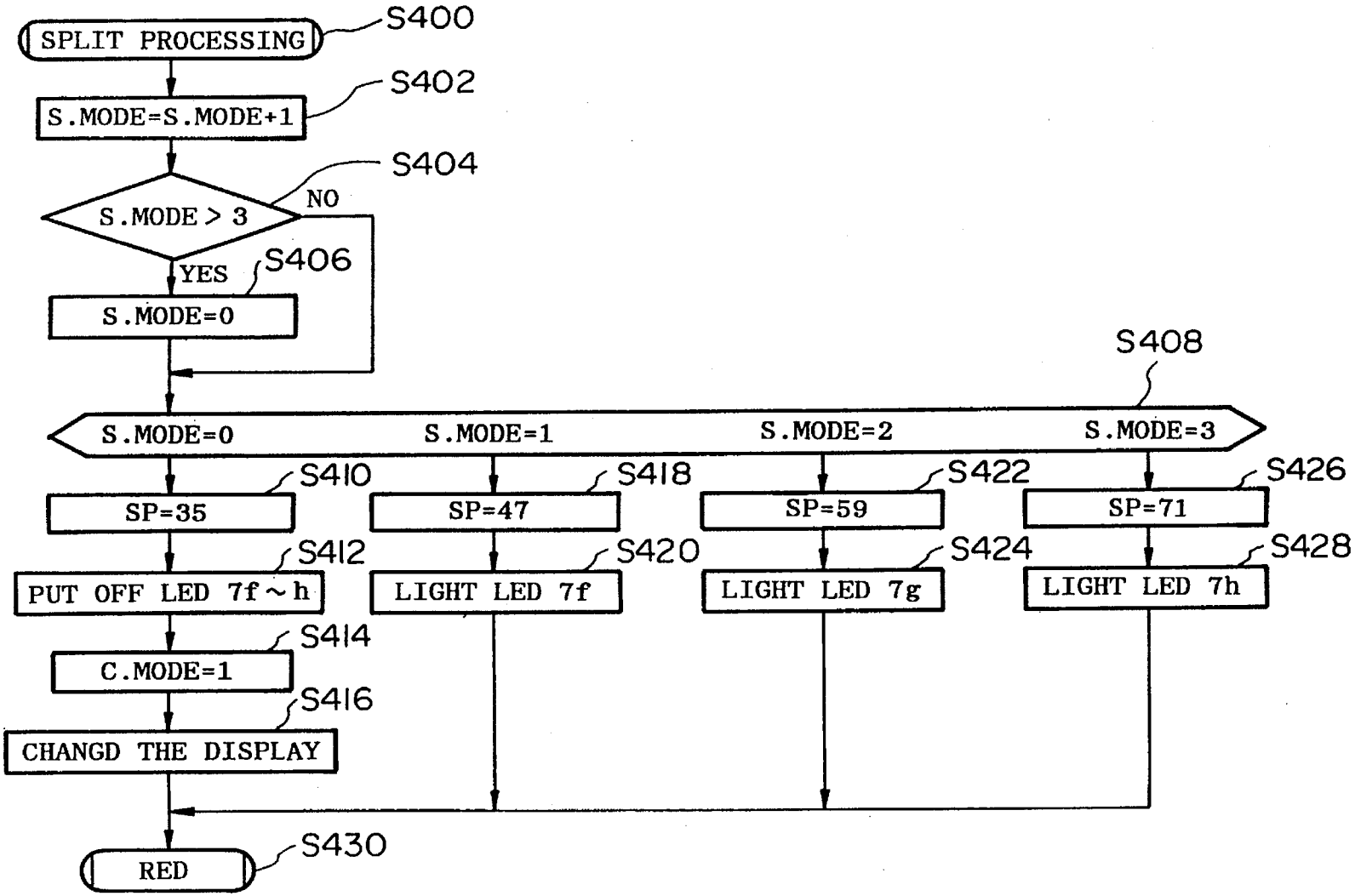
Figure 7:
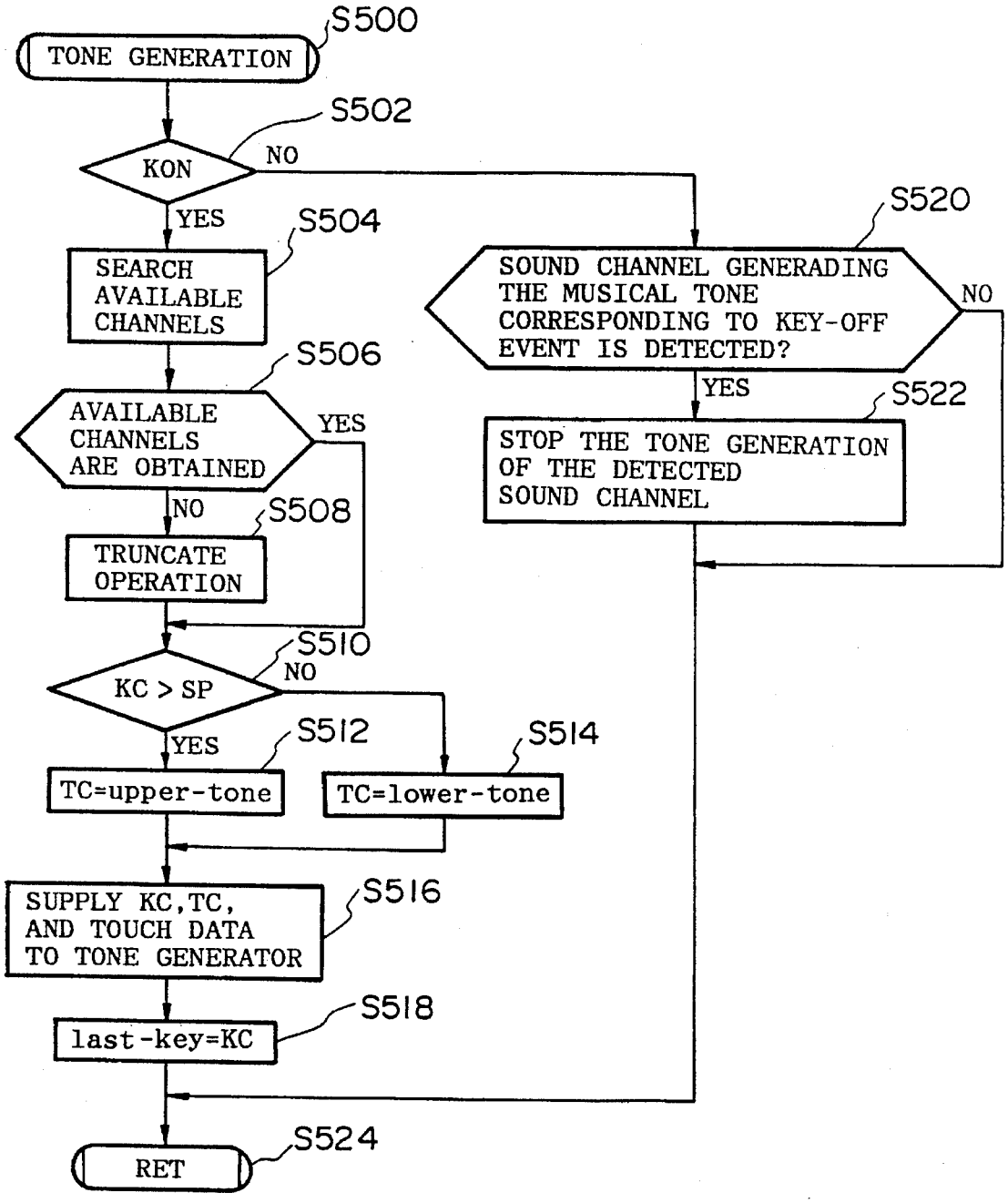

Hereinafter, the operation of the electronic musical instrument will be described with reference to FIGS. 3 through 7. When power switch 7a is turned on and electronic power is then supplied to the elements of the electronic musical instrument, CPU 3 executes a main routine, the flow chart of which is shown in FIG. 8. First, the routine proceeds to step S102 via step S100, wherein a initialization processing is performed. By this initialization processing, tone generator 9 is initialized and initial values are set to storage areas of RAM 5 which are used as control registers and control flags. For example, an initial value [0] is set to split register S.MODE, the content of which designates the division point or division state of the keys. The content [0] designates that all keys are not divided into any key ranges. Additionally, an initial value [1] is set to mode register C.MODE, the content of which designates the first or second timbre setting function. The value [1] designates the first timbre setting function. An initial value is set to a upper key timbre designation register upper-tone, the content of which designates the timbre to be assigned for the upper key range which is on the right side (i.e., upper key side) of the division point. An initial values is also set to a lower key timbre designation register lower-tone, the content of which designates the timbre to be assigned for the lower key range which is on the left side (i.e., lower key side) of the division point. Next, in S104, CPU 8 executes a key scan operation in which the output terminal of interface 2 is sensed. In the case where any operational events are output from interface 2, the events are detected by CPU 3. Next, the routine proceeds to step S106, wherein a judgement is made as to whether any event is detected by CPU 3 or not. When the result of this judgement is [Yes], the routine proceeds to step S108 to execute a tone generation routine, the flow chart of which is shown in FIG. 7, after which the routine proceeds to step S110. Whereas, when the result of the judgement is [No], the routine proceeds to step S110 without executing step S108. In step S110, i.e., when the judgement is yes, a panel scan operation is executed in which the output terminal of interface 8 is sensed. In the case where any operational events are output from interface 8, the event are detected by CPU 3. Next, in step S112, a judgement is made as to whether any events are detected by CPU 3 or not. In the case where the result of this judgement is [Yes], the routine proceeds to step S114 to executes a panel processing routine, the flow chart of which is shown in FIG. 4, after which control returns to step S104 of main routine. In the case where the result of the judgement in step S112 is [No], the routine returns to step S104 without executing step S114. Thereafter, the processing of steps S104 through S114 is repeatedly performed as described above.

When a performer operates an operational member provided on control panel 7, the operational event corresponding to the operational member is output from interface 8. As a result, when the routine proceeds to step S112 of the main routine, the result of the judgement in step S112 becomes [Yes], whereby the routine proceeds to step S114 to execute the panel processing routine shown in FIG. 4. The routine then proceeds to step S202 via step S200, wherein a judgement is made as to whether the event detected by CPU 3 in step S11O corresponds to split key 7b or not. When the result of this judgement is [Yes], the routine proceeds to step S204, whereas when the result is [No], the routine proceeds to step S206. In the case where the detected event does not correspond to split key 7b, the result of the judgement in step S202 is [No], whereby the routine proceeds to step S206. In step S206, a judgement is made as to whether the entered event corresponds to function selection key 7i or not. In the case where function selection key 7i has been depressed, the result of the judgement in step S206 is [Yes], whereby the routine proceeds to step S208. In step S208, the content of mode register C.MODE is inverted, and the name of the operational mode corresponding to the new content of C.MODE is then displayed on display 7c, after which the control returns to main routine. In the case where the operational member than function selection key 7i has been depressed, the result of the judgement in step S206 is [No], whereby the routine proceeds to step S210. In step S210, a judgement is made as to whether any one of timbre designation switches 7e has been depressed or not. When the result of this judgement is [Yes], the routine proceeds to step S212 to execute a tone selection routine, the flow chart of which is shown in FIG. 5, after which the control returns to the main routine, whereas when the result of the judgement is [No], the routine proceeds to step S214 to execute the processing for the other operational members, after which the control returns to the main routine.

When a performer depresses split key 7b, the operational event corresponding to the key is detected from interface 8, whereby the panel processing routine is executed via step S114. In step S202 of the panel processing routine, the result of the judgement is [Yes], whereby the routine proceeds to step S204 to execute a split processing routine, the flow chart of which is shown in FIG. 6. In this case, the routine proceeds to step S402 via step S400, wherein the content of split register S.MODE is incremented. Next, in step S404, a judgement is made as to whether the content of S.MODE is greater than [3] or not. When the result of this judgement is [Yes], the routine proceeds to step S406, wherein a value of [0] is set to split register S.MODE, after which the routine proceeds to step S408, whereas when the result of the judgement is [No], the routine proceeds directly to step S408 without executing step S406.

Next, in step S408, a branch operation is carried out based on the content of split register S.MODE. In the case where S.MODE=[0], the routine proceeds to step S410, wherein a value of [35], which is less than the key code of the lowest tone by one, is set to a division point register SP, the content of which designates the division point for dividing the keys of keyboard 1 into upper and lower key ranges. In this manner, all keys on keyboard 1 are defined as the keys included in the upper key range. Next, the routine proceeds to step S412, wherein LEDs 7f through 7h are put off, after which a value of [1] is set to mode register C.MODE (step S414). Next, in step S416, CPU 3 causes display 7*c* to display the message informing that the keys on the keyboard are not divided into key ranges, after which the control returns to the main routine.

In the case where S.MODE=[1], the routine proceeds from step S408 to step S418, wherein a value of [47] is set to division point register SP. Next, the routine proceeds to step S420, wherein LED 7*f* positioned at the point between the key corresponding to the key code [47] and the neighboring key in right side, i.e., the side toward upper tone, is lighted up, after which the control returns to the main routine. In the case where S.MODE=[2], a value of [59] is set to division point register SP (step S422) and LED 7*g* positioned at the point between the key corresponding to the key code [59] and the neighboring key in right side is then lighted up (step S424), after which the control returns to the main routine. In the case where S.MODE=[3], a value of [71] is set to division point register SP (step S426) and LED 7*h* positioned at the point between the key corresponding to the key code [71] and the neighboring key in right side is then lighted up (step S428), after which the control returns to the main routine.

When a performer depresses a key on keyboard 1, the key-on event is detected by interface 2, which then outputs a key-on signal KON to indicate that the key has been depressed. As a result, when the routine proceeds to step S106 via step S104 after the key has been depressed, the result of the judgement in step S106 is [Yes], whereby the routine proceeds to step S108 to execute the tone generation routine shown in FIG. 7. The routine proceeds to step S502 via step S500, wherein a judgement is made as to whether a key-on signal KON has been output or not, i.e., any key-on event has been detected or not. In this case, the result of this judgement is [Yes], whereby the routine proceeds to step S504, wherein available sound channels, not being used, are searched in the sound channels employed in tone generator 9. Next, in step S506, a judgement is made as to whether at least one available sound channel is obtained or not. In the case where all sound channels are used for tone generation, the result of the judgement in step S506 is [No], whereby the routine proceeds to step S508, wherein a truncate operation is carried out. In this operation, in the case where there is at least one sound channel used for generating a the musical tone having a key code, the priorities of which is lower than the priority of the key code of the key-on event, the tone generation through the use of the corresponding sound channels ceases to be assigned to the tone generation for the new key-on event, after which the routine proceeds to step S510. In the case where there are available sound channels, the result of the judgement in step S506 is [Yes], whereby the routine proceeds to step S510 without executing step S508.

Next, in step S510, a judgement is made as to whether key code KC of the key-on event is larger than the content of division point designation register SP or not. In the case where the result of this judgement is [Yes], i.e., the depressed key is arranged in the upper key range, which is on the upper tone side of the division point, the routine proceeds to step S512, wherein the content of timbre designation register upper-tone for the upper key range is set to timbre designation register TC, after which the routine proceeds to step S516. In the case where the result of this judgement in step S510 is [No], i.e., the depressed key is arranged in the lower key range, which is on the lower tone side of the division point, the routine proceeds to step S514, wherein the content of timbre designation register lower-tone for the lower key range is set to timbre designation register TC, after which the routine proceeds to step S516.

Next, in step S516, a timbre code stored in timbre designation register TC, a key code KC of the key-on event and the touch data indicating the touch intensity of the key, are assigned to one of the sound channels of tone generator 9, which has been reserved for the tone generation of the new key-on event. As a result, tone generator 9 generates a musical tone, which has a pitch corresponding to key code KC of the key-on event and a timbre designated by the content of TC. The generated musical tone is output from loudspeaker 11. In the case where no available sound channel is obtained in step S516, the routine proceeds to step S518 without executing the tone generation for the key-on event.

Next, in step S518, key code KC of the key-on event is set to a last key register last-key, which indicates the key code of the key last depressed, after which the control returns to main routine.

When the performer releases the key of keyboard 1 which has being depressed, the key-off event is output from interface 2 and key-on signal KON is deactivated. As a result, the key-off event is detected by CPU 3 in step S104 of the main routine, and when the routine proceeds to the tone generation routine via step S106, the result of the judgement in step S502 is [No], whereby the routine proceeds to step S520. In step S520, the key codes of the musical tones are detected, which are generated by the respective sound channels of tone generator 9, and then a judgement is made as to whether there is a sound channel which is generating the musical tone having the key code corresponding to the key-off event which has been detected in step S104 or not. In the case the result of this judgement is [No], the control returns to the main routine. In the case where the result of the judgement in step S520 is [Yes], the routine proceeds to step S522, wherein CPU 8 causes tone generator 9 to stop the tone generation of the musical tone, which has the key code corresponding to the key-off event. After the completion of step S522, the control returns to the main routine.

When the performer operates timbre designation key 7*e* on control panel 7, the operational event is output from interface 8. As a result, when the routine proceeds to the panel processing routine via step S114 of the main routine, the result of the judgement in step S210 is [Yes], whereby the routine proceeds to step S212 to execute the timbre selection routine shown in FIG. 5. The routine proceeds to step S302 via step S300, wherein a judgement is made as to whether the key code stored in last key register last-key is greater than the content of division point register SP or not.

In the case where the key last depressed is arranged on upper tone side of the division point, the result of the judgement in step S302 is [Yes], whereby the routine proceeds to step S304, wherein a judgement is made as to whether the content of mode register C.MODE is [1] or not. In the case where C.MODE=[1], the routine proceeds from step S304 to step S308, wherein the timbre code corresponding to the operated timbre designation key 7*e* is stored in timbre designation register upper-tone for the upper key range, after which the control returns to the main routine. In the case where C.MODE=[0], the routine proceeds from step S304 to step S310, wherein the timbre code corresponding to the operated timbre designation key 7*e* is stored in timbre designation register lower-tone for the lower key range, after which the control returns to the main routine.

On the other hand, in the case where the key last depressed is arranged on lower tone side of the division point, the result of the judgement in step S302 is [No], whereby the routine proceeds to step S806, wherein a judgement is made as to whether the content of mode register C.MODE is [1] or not. In the case where C.MODE=[1], the routine proceeds from step S306 to step S310, wherein the timbre code corresponding to the operated timbre designation key 7*e* is stored in timbre designation register lower-tone for the lower key range, after which the control returns to the main routine. In the case where C.MODE=[0], the routine proceeds from step S306 to step S308, wherein the timbre code corresponding to the operated timbre designation key 7*e* is stored in timbre designation register upper-tone for the upper key range, after which the control returns to the main routine.

In this manner, when C.MODE=[1], the timbre code corresponding to the operated timbre designation key 7*e* is assigned for the key range which includes the last depressed key. In contrast, when C.MODE=[0], the timbre code corresponding to the operated timbre designation key 7*e* is assigned for the key range which does not include the last depressed key.

In the above preferred embodiment, the description is given with respect to the case in which the keys on keyboard 1 are divided into two key ranges. However, the present invention can be applied to the case in which the keys on keyboard are divided into a plurality of key ranges, the number of which is more than 3. In this case, a method is necessary in which one of the key ranges is selected in the key ranges when C.MODE=[0], which does not include the last depressed key, and for which the entered tone control parameter is to be assigned. However, appropriate methods can be used, for example, a method in which the neighboring key range on the upper tone side of the key range, which includes the last depressed key, is selected for this case. Additionally, in the above preferred embodiment, the description is given with respect to the case in which the timbre code is assigned to one of the key ranges as a tone control parameter. As well, the present invention can be applied to the setting of the other tone control parameters. For example, the tone control parameter assigned for one of the key ranges may be the tone control parameter which causes a shift in the pitch of the musical tone to be generated by one octave or few octaves. Further more, in the above preferred embodiment, the description is given with respect to the case in which only one keyboard is employed in the electronic musical instrument. However, the control method for assigning tone control parameter according to the present invention can be applied to the electronic musical instrument having two or more keyboards connected to each other. In this case, it is impossible to search the key range including the depressed key based only on the key-on event. Accordingly, the electronic musical instrument must be improved so that when one of the keyboards is operated, a signal designating the operated keyboard is output, and the key range including the depressed key is detected based on the signal.

What is claimed is:

1. An electronic musical instrument having a keyboard, on which a plurality of keys is provided, and generating musical tones based on an operation applied to the keys, the electronic musical instrument comprising:

division point designation means for designating at least one division point which divides the keys of the keyboard into a plurality of key ranges;

parameter input means for inputting a desired tone control parameter which is common to each of the plurality of key ranges;

operation key range selection means for selecting a key range from the plurality of key ranges on the basis of a last operated key of the keyboard; and parameter assign means for assigning the input tone control parameter to the selected key range.

2. An electronic musical instrument according to claim 1 wherein the parameter assign means includes a function selection switch, whereby either the key range including the operated key or one of the key ranges not including the operated key is selected according to the operation applied to the function selection switch as the key range for which the input tone control parameter is assigned.

3. An electronic musical instrument according to claim 1, wherein said division point designation means includes a split switch for instructing the move of the division point and a register, the content of which designates the division point and is updated every time the split switch is operated.

4. An electronic musical instrument according to claim 1 wherein in the case where multiple keys of the keyboard are consecutively depressed, the parameter assign means assigns the input tone control parameter for the key range which includes the last depressed key.

* * * * *